US007808284B2

(12) United States Patent
Tanaka

(10) Patent No.: US 7,808,284 B2
(45) Date of Patent: Oct. 5, 2010

(54) CONSTANT CURRENT DRIVE DEVICE

(75) Inventor: Yoshimitsu Tanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 820 days.

(21) Appl. No.: 10/585,338

(22) PCT Filed: Nov. 9, 2005

(86) PCT No.: PCT/JP2005/020978

§ 371 (c)(1),
(2), (4) Date: Jul. 6, 2006

(87) PCT Pub. No.: WO2006/051992

PCT Pub. Date: May 18, 2006

(65) Prior Publication Data

US 2009/0121750 A1 May 14, 2009

(30) Foreign Application Priority Data

Nov. 10, 2004 (JP) ..... 2004-326794

(51) Int. Cl.
*H03B 1/00* (2006.01)

(52) U.S. Cl. ..... 327/108; 327/538; 345/76; 345/98

(58) Field of Classification Search ..... None
See application file for complete search history.

(56) References Cited

U.S. PATENT DOCUMENTS 5,963,071 A * 10/1999 Dowlatabadi ..... 327/175

(Continued)

FOREIGN PATENT DOCUMENTS

JP 62-121492 6/1987

(Continued)

OTHER PUBLICATIONS

Japanese Office Action issued Dec. 24, 2008 for corresponding Japanese Application No. 2004-326794.

(Continued)

*Primary Examiner*—Tuan Lam
(74) *Attorney, Agent, or Firm*—Rader, Fishman & Grauer PLLC

(57) ABSTRACT

An object of the present invention is to eliminate fluctuation in the value of the constant current I even if there is characteristic fluctuation in field effect transistors and at the same time, to improve the power consumption. There are provided with a plurality of current mirror circuits consisting of those on the reference side and on the mirror side; current holding capacitors 21*a*, 21*b* and 21*c* provided on the respective mirror sides of the plurality of current mirror circuits; sequential selection means 23, 24*a*, 24*b* and 24*c* for selecting the plurality of current mirror circuits sequentially by a constant period; first switching means 22*a*, 22*b* and 22*c* for connecting respective reference sides and mirror sides of the plurality of current mirror circuits; reference voltage change-over means 23, 25 and 26 for changing over reference voltages of constant current generation units 5, 7 and 8 such that currents on the mirror sides become constant in conformity with the selection period of the plurality of current mirror circuits; and second switching means 20*a*, 20*b* and 20*c* for connecting the constant current generation units 5, 7 and 8 to the reference sides of the plurality of current mirror circuits in conformity with the selection period.

7 Claims, 5 Drawing Sheets

U.S. PATENT DOCUMENTS

| | | | | |
|---|---|---|---|---|
| 6,222,357 | B1 * | 4/2001 | Sakuragi | 323/315 |
| 6,535,185 | B2 * | 3/2003 | Kim et al. | 345/76 |
| 6,570,338 | B2 * | 5/2003 | Bae | 315/169.3 |
| 6,580,408 | B1 * | 6/2003 | Bae et al. | 345/76 |
| 6,683,417 | B2 * | 1/2004 | Lee et al. | 315/169.3 |
| 6,686,699 | B2 * | 2/2004 | Yumoto | 315/169.3 |
| 7,145,542 | B2 * | 12/2006 | Kasai | 345/98 |
| 7,271,784 | B2 * | 9/2007 | Koyama | 345/76 |
| 7,427,892 | B2 * | 9/2008 | Fujikura et al. | 327/540 |
| 2003/0062524 | A1 | 4/2003 | Kimura | |
| 2003/0189541 | A1 | 10/2003 | Hashimoto | |

FOREIGN PATENT DOCUMENTS

| | | | |
|---|---|---|---|
| JP | 62-121492 | A | 6/1987 |
| JP | 2-019909 | | 1/1990 |
| JP | 02-019909 | A | 1/1990 |
| JP | 2000-081920 | | 3/2000 |
| JP | 2000-081920 | A | 3/2000 |
| JP | 2003-187988 | | 7/2003 |
| JP | 2003-187988 | A | 7/2003 |

OTHER PUBLICATIONS

Extended European Search Report with a Supplemental Search Report and Opinion dated Dec. 8, 2008 for corresponding European Application No. 05 80 6605.

PCT International Search Report for PCT/JP2005/020978 mailed on Feb. 14, 2006.

* cited by examiner

FIG. 3A Clock
"1"
"0"
FIG. 3B Current Mirror Selection Pulse 1
"1"
"0"
FIG. 3C Current Mirror Selection Pulse 2
"1"
"0"
FIG. 3D Current Mirror Selection Pulse 3
"1"
"0"
FIG. 3E ROM Address
FIG. 3F DAC OUT Vref (Reference Voltage Vref)
Voltage
Va
Vb
Vc
FIG. 3G Current Mirror Ckt Mirror Side Voltage
Current
Refresh Period

CONSTANT CURRENT DRIVE DEVICE

TECHNICAL FIELD

The present invention relates to a constant current drive device preferably applied for driving a display device in which current drive devices such as organic electroluminescence devices (hereinafter, referred to as organic EL devices), light emitting diodes (hereinafter, referred to as LEDs) or the like are arranged in a matrix form.

BACKGROUND ART

In the past, there was proposed a display device in which current drive devices 1 such as organic EL devices, LEDs or the like are arranged in a matrix form as shown in FIG. 4. Although there is described a display device in the example of FIG. 4 in which the current drive devices 1 are in a matrix form by 3×3 units in order to simplify the explanation thereof, a picture display device in which they are in a matrix form, for example, by 500×500 units was realized practically.

A line sequential drive is carried out for driving the display device in which the current drive devices 1 are arranged in a matrix form as shown in FIG. 4. In this case, current sources 2*a*, 2*b* and 2*c* are generally used as drive sources of the current drive devices 1.

In order to display pictures in the display device in which the current drive devices 1 are arranged in a matrix form as shown in this FIG. 4, it is enough if horizontal lines are selected sequentially by connection switches 3*a*, 3*b* and 3*c* and currents in response to picture brightness is to be flown to respective vertical lines. In this case, is line sequential, so that it is necessary to flow the currents of the respective vertical lines in synchronism with the horizontal lines all together.

In order to flow currents in response to the picture brightness, current sources 2*a*, 2*b* and 2*c* are made to be constant currents respectively and connection switches 4*a*, 4*b* and 4*c* are turned on/off by pulse width modulation (PWM (Pulse Width Modulation)) signals in response to the picture brightness. More specifically, it is enough if the connection switches 4*a*, 4*b* and 4*c* are to be turned on-off in response to the picture brightness within the time period while the horizontal lines thereof are selected by the connection switches 3*a*, 3*b* and 3*c*. When it is desired to make the brightness higher, the on-time thereof is made longer and when it is desired to make the brightness darker, the on-time thereof is made shorter.

There was proposed in the past, as a constant current circuit used in the current sources 2*a*, 2*b* and 2*c*, a circuit as shown in FIG. 5. It will be explained with respect to this FIG. 5, wherein 5 designates an operational amplifier circuit constituting a constant current generation unit, a non-inversion input terminal + of the operational amplifier circuit 5 is grounded through a battery 6 for obtaining a reference voltage Vref which determines a value of a constant current I, and an inversion input terminal − of the operational amplifier circuit 5 is grounded through a resistor 7.

Also, an output terminal of the operational amplifier circuit 5 is connected to a gate of an n-type field effect transistor 8, a source of the field effect transistor 8 is connected to the inversion input terminal − of the operational amplifier circuit 5, a drain of the field effect transistor 8 is connected to a connection point between a drain and a gate of a diode connected p-type field effect transistor 9 which constitutes a transistor on the reference side a current mirror circuit, and a source of the field effect transistor 9 is connected to a power supply terminal 10 supplied with a positive direct voltage.

It is constituted such that the gate of the field effect transistor 9 is connected to a gate of a p-type field effect transistor 11 which constitutes a transistor on the mirror side of the current mirror circuit, a source of the field effect transistor 11 is connected to the power supply terminal 10, and a drain of the field effect transistor 11 is connected, for example, to the connection switch 4*a*.

The current I flowing between the drain and the source of the field effect transistor 8 of the constant current generation unit becomes $$I=Vref\div R$$

and it becomes a constant current value. Here, Vref is a reference voltage by the battery 6 and R is a resistance value of the resistor 7.

The constant current I is supplied from the field effect transistor 9, the constant current I also flows through the field effect transistor 11 on the mirror side which constitutes a current mirror circuit together with the field effect transistor 9, and the constant current I is supplied to the current drive device 1 constituting a display device, for example, through the connection switch 4*a*.

When such a constant current circuit shown in FIG. 5 is used for the current sources 2*a*, 2*b* and 2*c* of the display device as shown in FIG. 4, a big number of, for example, 500 units of the constant current circuit as shown in this FIG. 5 becomes necessary and the circuit scale thereof becomes large and at the same time, there is inconvenience that the power consumption becomes large.

Consequently, a constant current drive device in which the current drive devices 1 are arranged in a matrix form was propose wherein the operational amplifier circuit 5, the battery 6 and resistor 7 of the constant current generation unit are made to be common for all of the current mirror circuits as shown in FIG. 6. To explain with respect to this FIG. 6, the same reference numerals are put in this FIG. 6 for the portions corresponding to those in FIG. 5 and the detailed explanation thereof will be omitted.

In this FIG. 6, the non-inversion input terminal + of the operational amplifier circuit 5 constituting the constant current generation unit is grounded through the battery 6 obtaining the reference voltage Vref for determining the value of the constant current I and the inversion input terminal − of the operational amplifier circuit 5 is grounded through the resistor 7.

Also, the output terminal of the operational amplifier circuit 5 is connected to the respective gates of the field effect transistors corresponding to the number of all of the current mirror circuits, for example, 500 units and, in case of FIG. 6, 3 units of the n-type field effect transistors 8*a*, 8*b* and 8*c*, and the respective sources of the field effect transistors 8*a*, 8*b* and 8*c* are connected to the inversion input terminal − of the operational amplifier circuit 5.

Further, the respective drains of the field effect transistors 8*a*, 8*b* and 8*c* are connected to the connection points of the respective gates and drains of the diode connected p-type field effect transistors 9*a*, 9*b* and 9*c* which constitute the reference sides of the current mirror circuits respectively, and the respective sources of the field effect transistors 9*a*, 9*b* and 9*c* are connected to the power supply terminal 10 supplied with the positive direct voltage.

It is constituted such that the respective gates of the field effect transistors 9*a*, 9*b* and 9*c* are respectively connected to the respective gates of the p-type field effect transistors 11*a*, 11*b* and 11*c* which constitute the mirror sides of the respective current mirror circuits, the respective sources of the field effect transistors 11*a*, 11*b* and 11*c* are connected to the power supply terminal 10, the respective drains of the field effect transistors 11*a*, 11*b* and 11*c* are connected, for example, to the connection switches 4*a*, 4*b* and 4*c* respectively.

The current I flowing between the drain and the source of each of the field effect transistor 8*a*, 8*b* and 8*c* of the constant current generation unit becomes I=Vref÷nR (n is the number of current mirrors connected in parallel), and it becomes a constant current value.

The constant currents I are supplied from the respective field effect transistors 9*a*, 9*b* and 9*c* respectively, the constant currents I flow also through the respective field effect transistors 11*a*, 11*b* and 11*c* on the mirror sides which constitute respective current mirror circuits together with the field effect transistors 9*a*, 9*b* and 9*c*, and this constant currents I are supplied to the current drive devices 1 constituting the display device, for example, through the connection switches 4*a*, 4*b* and 4*c*.

There was proposed in the past a device disclosed in a Patent Reference 1 as a constant current drive device of a display device in which current drive devices are arranged in a matrix form.

[Patent Reference 1] Laid-open Patent Publication H11-338561

DISCLOSURE OF THE INVENTION

However, there are characteristic fluctuations in the field effect transistors 8*a*, 8*b*, 8*c*, 9*a*, 9*b*, 9*c*, 11*a*, 11*b* and 11*c* as shown in FIG. 6 and there is inconvenience that fluctuations occur in the values of the respective constant currents I caused by the characteristic fluctuations of the field effect transistors and at the same time, in a plurality of current mirror circuits, for example, of 500 units, there is inconvenience that the power consumption thereof becomes large, because the same currents always flow through the transistors on the reference sides and through the transistors on the mirror sides.

In view of the aforementioned aspects, the present invention has an object in which fluctuations in the values of the constant currents I are to be eliminated even if there are characteristic fluctuations in the field effect transistors and at the same time, the power consumption is improved.

The constant current drive device according to the present invention is provided with a plurality of current mirror circuits consisting of transistors on reference sides and transistors on mirror sides, current holding capacitors provided at the respective transistors on the mirror sides of the plurality of current mirror circuits, sequential selection means for selecting the plurality of current mirror circuits sequentially by a constant period, first switching means for connecting the respective transistors on the reference sides and transistors on mirror sides of the plurality of current mirror circuits, reference voltage change-over means for changing over a reference voltage of a constant current generation unit such that currents of the transistors on the mirror sides become constant in conformity with the selection period of the plurality of current mirror circuits, and second switching means for connecting the constant current generation unit to the transistors on the reference sides of the plurality of current mirror circuits in conformity with the selection period.

It is constituted according to the present invention mentioned above such that the reference voltage of the constant current generation unit is changed over so as to make the currents on the mirror sides to become constant in conformity with selection periods of the plurality of current mirror circuits, so that it is possible to eliminate fluctuations of the values of the constant currents I even if there are, for example, characteristic fluctuations of the field effect transistors used therein.

Also, it is constituted according to the present invention such that the constant currents I are made to flow only on the mirror side by current holding capacitors in the current mirror circuits other than the current mirror circuits selected from the plurality of current mirror circuits, so that the power consumption is improved to be approximately half.

BEST MODE FOR CARRYING OUT THE INVENTION

Figure 6:
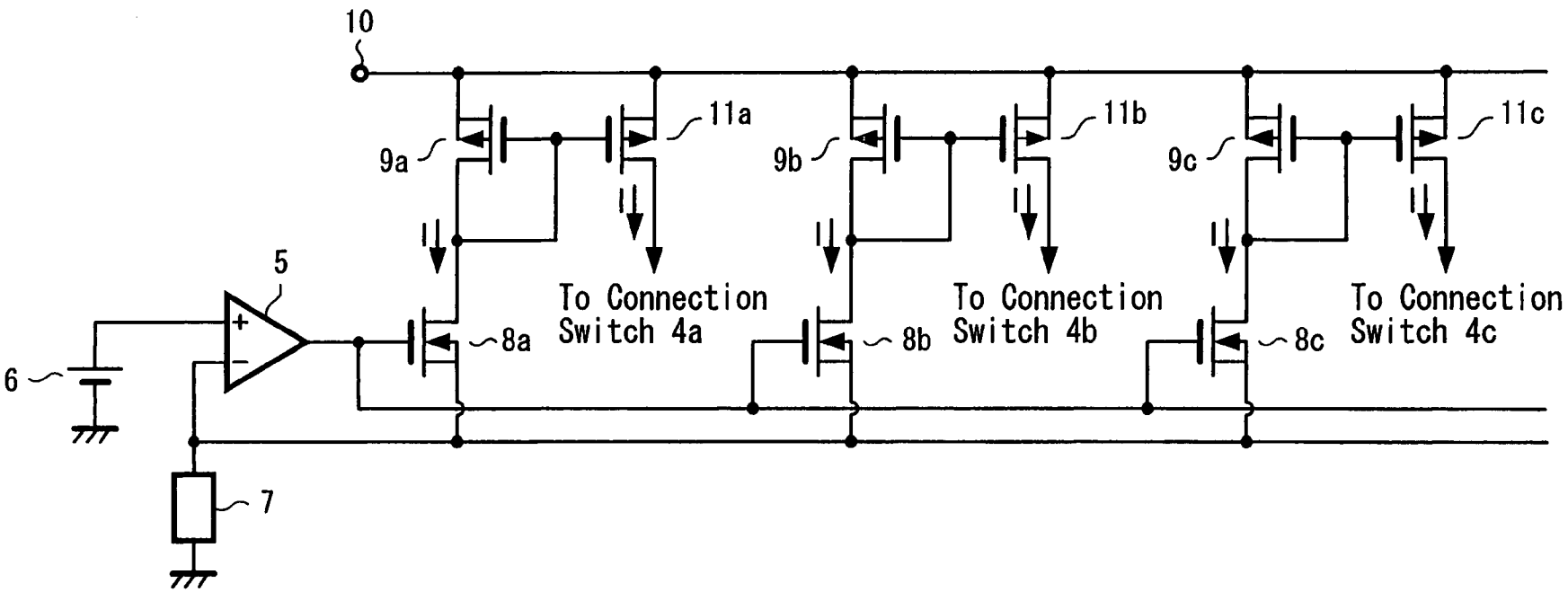
FIG. 6 is a constitutional diagram showing an example of a constant current drive device.

Hereinafter, it will be explained with respect to the best mode example in order to carry out a constant current drive device of the present invention with reference to FIG. 1, FIG. 2 and FIG. 3. In these FIG. 1 and FIG. 2, portions corresponding to those in FIG. 6 are shown by putting the same reference numerals.

Figure 1:
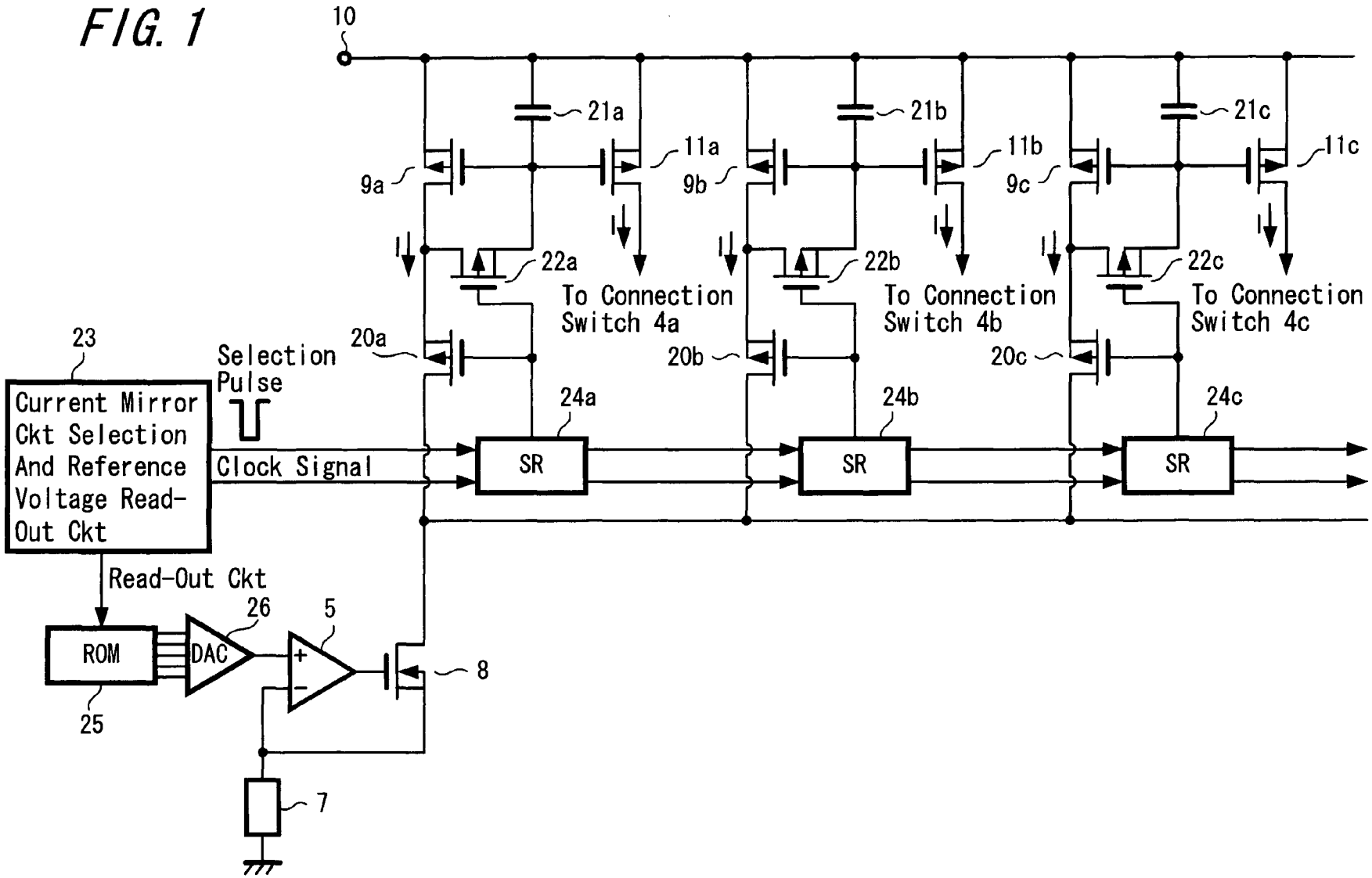
FIG. 1 is a constitutional diagram showing an example of the best mode for carrying out a constant current drive device of the present invention.

In this example, as shown in FIG. 1, an inversion input terminal − of the operational amplifier circuit 5 which constitutes a constant current generation unit is grounded through the resistor 7. An output terminal of the operational amplifier circuit 5 is connected to the gate of the n-type field effect transistor 8 and the source of the field effect transistor 8 is connected to the inversion input terminal − of the operational amplifier circuit 5.

Also, in this example, the drain of the field effect transistor 8 constituting the constant current generation unit is connected to respective drains of p-type field effect transistor 20*a*, 20*b* and 20*c* constituting connection switches respectively, respective sources of the field effect transistor 20*a*, 20*b* and 20*c* constituting the connection switches are connected to the respective drains of the p-type field effect transistors 9*a*, 9*b* and 9*c* constituting the reference sides of the current mirror circuits respectively, and the respective sources of the field effect transistors 9*a*, 9*b* and 9*c* are connected to the power supply terminal 10 supplied with the positive direct voltage.

It is constituted such that the respective gates of the field effect transistors 9*a*, 9*b* and 9*c* are respectively connected to the respective gates of the p-type field effect transistors 11*a*, 11*b* and 11*c* constituting the mirror sides of the current mirror circuits respectively, the respective sources of the field effect transistors 11*a*, 11*b* and 11*c* are connected to the power supply terminal 10, and the respective drains of the field effect transistors 11*a*, 11*b* and 11*c* are connected, for example, to the connection switches 4*a*, 4*b* and 4*c* respectively.

In this example, respective connection points of the respective gates of the field effect transistors 9*a*, 9*b* and 9*c* and the respective gates of the field effect transistors 11*a*, 11*b* and 11*c* are connected to the power supply terminal 10 through current holding capacitors 21*a*, 21*b* and 21*c* which maintains gate voltages in order to maintain the currents of the field effect transistors 11*a*, 11*b* and 11*c* on the mirror sides respectively.

Also, in this example, respective drains of the field effect transistors 9*a*, 9*b* and 9*c* are connected to the respective drains of the p-type field effect transistors 22*a*, 22*b* and 22*c* constituting connection switches respectively and respective sources of the field effect transistors 22*a*, 22*b* and 22*c* are connected to the respective gates of the field effect transistors 9*a*, 9*b* and 9*c* respectively.

Further, in FIG. 1, 23 designates a current mirror circuit selection and reference voltage read-out circuit for selecting current mirror circuits constituted by a microcomputer or the like sequentially and concurrently for reading out preset reference voltages sequentially and it is constituted such that a clock signal as shown in FIG. 3*a* which the current mirror circuit selection and reference voltage read-out circuit 23 generates is supplied to shift registers 24*a*, 24*b* and 24*c* and at the same time, selection pulses are supplied to the shift registers 24*a*, 24*b* and 24*c* sequentially in synchronism with the clock signal as shown in FIGS. 3*b*, 3*c* and 3D, and the shift registers 24*a*, 24*b* and 24*c* are to be selected at every predetermined periods.

The shift register 24*a* is connected to the respective gates of the field effect transistors 20*a* and 22*a* constituting connection switches such that the field effect transistors 20*a* and 22*a* will be turned on when a selection pulse is supplied to the shift register 24*a* and also, the shift register 24*b* is connected to the respective gates of the field effect transistors 20*b* and 22*b* constituting connection switches such that the field effect transistors 20*b* and 22*b* will be turned on when a selection pulse is supplied to the shift register 24*b* and further, the shift register 24*c* is connected to the respective gates of the field effect transistors 20*c* and 22*c* constituting connection switches such that the field effect transistors 20*c* and 22*c* will be turned on when a selection pulse is supplied to the shift register 24*c*.

Consequently, the field effect transistor 20*a* and 22*a*, 20*b* and 22*b*, and 20*c* and 22*c* constituting connection switches will be turned on sequentially by the selection pulses which are shifted sequentially by the clock signal, so that it never happens that they are turned on concurrently.

Figure 2:
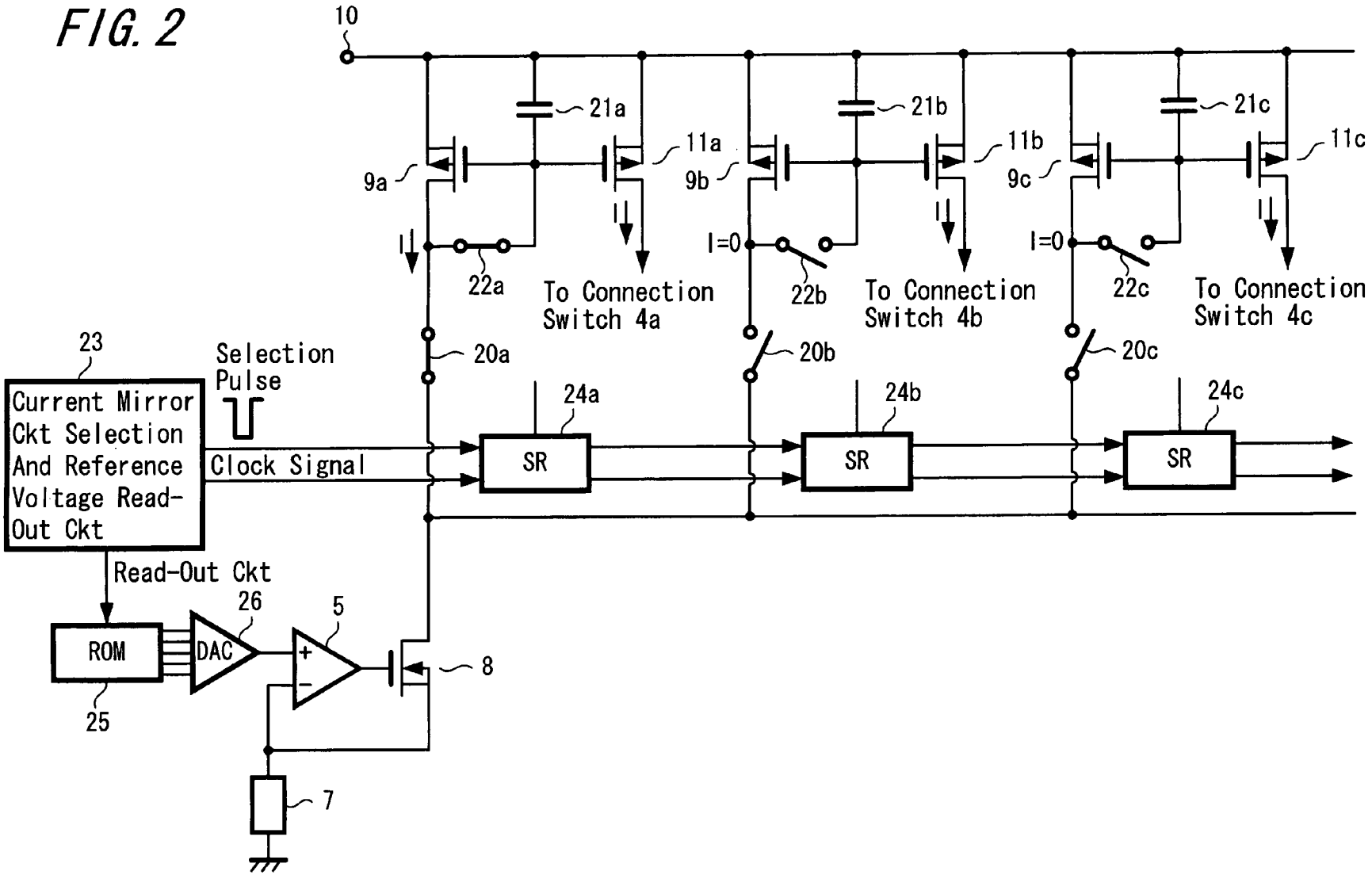
FIG. 2 is a constitutional diagram used for explaining FIG. 1.
Figure 3:
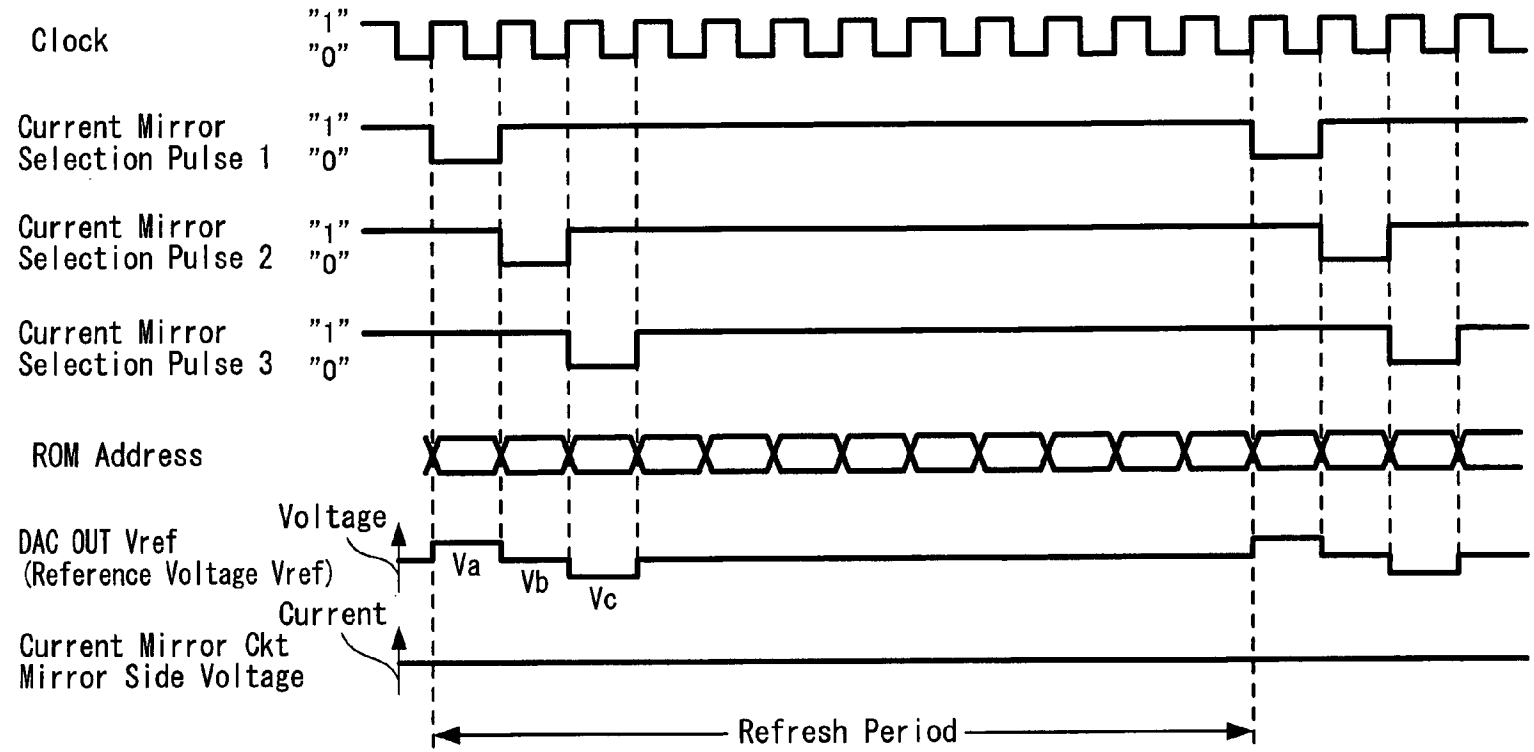
FIG. 3, consisting of FIG. 3A-3G, is a diagram used for explaining FIG. 1.
Figure 4:
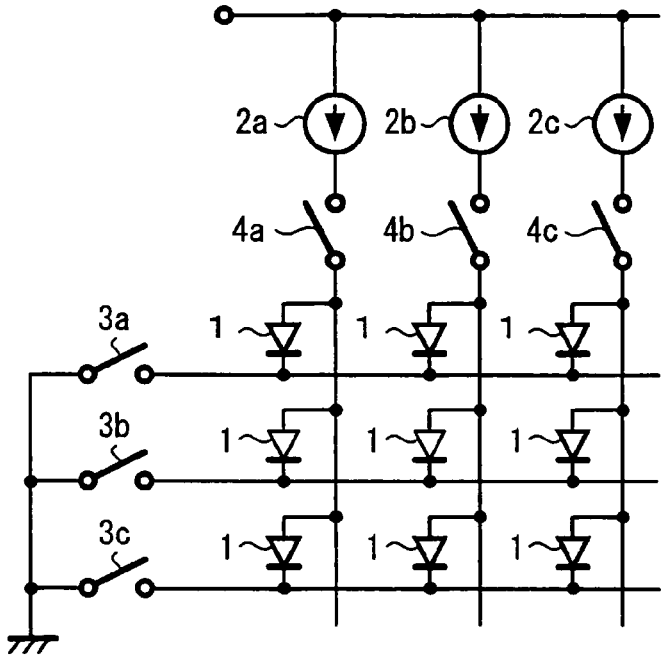
FIG. 4 is a constitutional diagram showing an example of a display device in which current drive devise are arranged in a matrix form.
Figure 5:
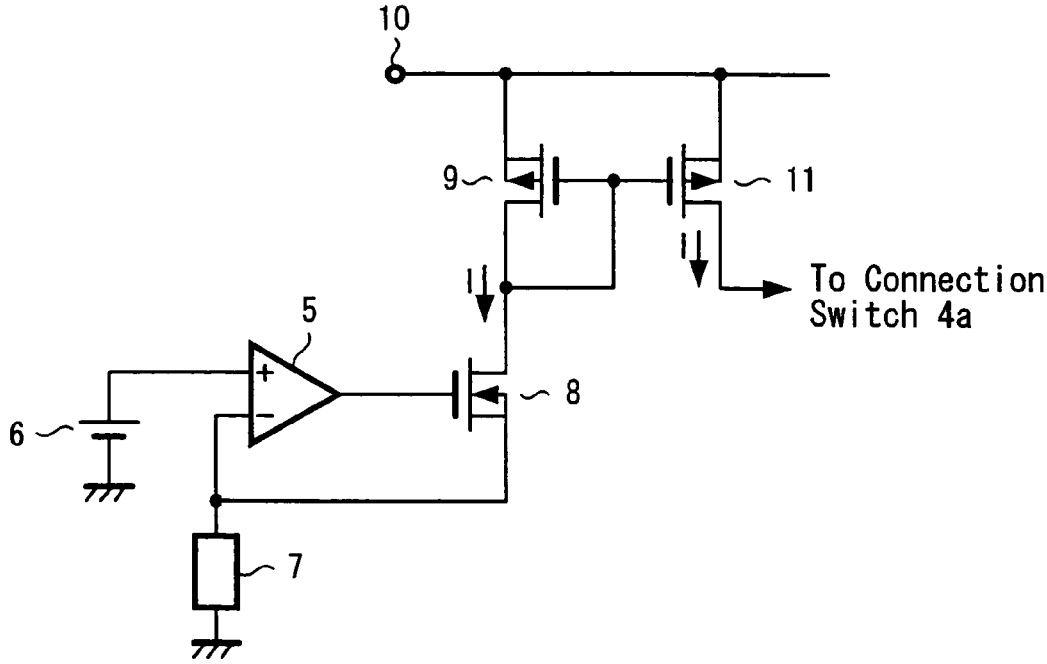
FIG. 5 is a constitutional diagram showing an example of a constant current circuit.

For example, when the selection pulse is supplied to the shift register 24*a*, as shown in FIG. 2, the field effect transistors 20*a* and 22*a* are turned on and it is a state in which the field effect transistors 20*b* and 22*b*, and 20*c* and 22*c* are in an OFF state.

In FIG. 1, 25 designates a memory device consisting of ROM or the like stored with data in a predetermined address by corresponding to the characteristic fluctuations of the field effect transistors constituting respective current mirror circuits such that the values of the constant currents I flowing through the respective field effect transistors 11*a*, 11*b* and 11*c* on the mirror sides of the plurality of current mirror circuits become constant as shown in FIG. 3G and by measuring reference voltages Va, Vb and Vc as shown in FIG. 3F which are supplied to the non-inversion input terminal + of the operational amplifier circuit 5 respectively beforehand.

With respect to the memory device 25, it is constituted such that the reference voltage which is specified beforehand for flowing a certain constant current I through the field effect transistor on the mirror side of the current mirror circuit and which is supplied from the current mirror circuit selection and reference voltage read-out circuit 23 is to be read out by the read-out address as shown in FIG. 3E.

It is constituted such that the digital reference voltage read out from the memory device 25 is supplied to a digital to analog converter circuit 26 the reference voltages Va, Vb and Vc as shown in FIG. 3F which are obtained on the output side of the digital to analog converter circuit 26 are to be supplied to the non-inversion input terminal + of the operational amplifier circuit 5 in synchronism with the selection of the current mirror circuits.

Since this example is constituted as mentioned above, when, for example, the first shift register 24*a* is selected by the selection pulse, the field effect transistors 20*a* and 22*a* constituting the connection switches will be turned on and the field effect transistors 20*b* and 22*b*, and 20*c* and 22*c* constituting the connection switches will be in an OFF state as shown in FIG. 2.

With respect to the current mirror circuit in which the field effect transistors 20*a* and 22*a* constituting the connection switches are turned on, the field effect transistor 9*a* on the reference side thereof is connected to the field effect transistor 8 of the constant current generation unit and the constant current I flows through the field effect transistor 11*a* on the mirror side thereof.

In this case, according to this example, the reference voltage Va of the first current mirror circuit is read out from the memory device 25 by means of the read out signal from the current mirror circuit selection and reference voltage read-out circuit, the reference voltage Va is supplied to the non-inversion input terminal + of the operational amplifier circuit 5 and the constant current I flows in consideration of characteristic fluctuations of the field effect transistors 9*a* and 11*a*.

At that time, current flows through the current holding capacitor 21*a* and electric charge maintaining the gate voltage for flowing constant current through the field effect transistor 11*a* on the mirror side continuously is charged in the current holding capacitor 21*a*.

When the second and the third shift registers 24*b* and 24*c* are selected by the selection pulse, it is operated similarly as mentioned above.

With respect to the current mirror circuits in which the field effect transistors 20*b* and 22*b*, and 20*c* and 22*c* constituting the connection switches are in the OFF state, the currents of the field effect transistors 9*b* and 9*c* on the reference side are "0". The currents of the field effect transistor 11*b* and 11*c* on the mirror side are "0" only at the very beginning, but after they are selected by the selection pulse, it is possible to flow a constant current I there-through continuously by electric charges held in the current holding capacitors 21*b* and 21*c*.

On the other hand, electric charges accumulated in the current holding capacitors 21*a*, 21*b* and 21*c* will discharge when the time elapses, so that it is necessary to charge them in a proper period and it is to be solves by a fact that the field effect transistor 20*a* and 22*a*, 20*b* and 22*b*, and 20*c* and 22*c* constituting connection switches are to be turned on periodically.

Also, it is constituted when the second and the third shift registers 24*b* and 24*c* are selected by the selection pulse such that the reference voltages Vb and Vc which flow the certain constant current I which is stored in the memory device 25 in consideration of characteristic fluctuations of the field effect transistor 9*b* and 11*b*, and 9*c* and 11*c* in the second and the third current mirror circuits are read out by the read out signal from the current mirror circuit selection and reference voltage read-out circuit 23 and they are supplied to the non-inversion input terminals + of the operational amplifier circuits 5, so that it is possible to flow the certain constant current I through the field effect transistor 11*b* and 11*c* on the mirror side.

According to this example, it is constituted such that the reference voltage Va, Vb and Vc of the constant current generation units are changed over so as to make the currents of the field effect transistors 11*a*, 11*b* and 11*c* on the mirror side to become constant in conformity with the selection periods of the plurality of current mirror circuits, so that it is possible to eliminate the fluctuation in the value of the constant current I even if there is characteristic fluctuation of the field effect transistor.

Also, according to this example, it is constituted such that the current mirror circuits other than the selected current mirror circuits in the plurality of current mirror circuits are made to flow the constant current I only through the field effect transistors 11*a*, 11*b* and 11*c* on the mirror side by the current holding capacitors 21*a*, 21*b* and 21*c*, so that the power consumption can be improved to be as much as approximately half.

It should be noted in the examples mentioned above that it was mentioned with respect to examples in which the current mirror circuits are constituted by using field effect transistors, but it needless to say that it is possible to use ordinary transistors instead of field effect transistors.

Further, the present invention is not limited by the examples mentioned above and it is needless to say that other various constitutions can be employed without departing from the scope of the present invention.

The invention claimed is:

1. A constant current drive device comprising:

a plurality of current mirror circuits consisting of those on a reference side and on a mirror side;

current holding capacitors provided on the respective mirror sides of said plurality of current mirror circuits;

sequential selection means for selecting said plurality of current mirror circuits sequentially by a constant selection period;

first switching means for connecting respective reference sides and mirror sides of said plurality of current mirror circuits;

reference voltage change-over means for changing over a reference voltage of a constant current generation unit in conformity with the selection period of said plurality of current mirror circuits; and second switching means for connecting said constant current generation unit to the reference sides of said plurality of current mirror circuits in conformity with said selection period, wherein said reference voltage change-over means comprises memory means for storing a plurality of reference voltages of an operational amplifier circuit corresponding to characteristic fluctuations of respective transistors of said mirror side.

2. A constant current drive device according to claim 1, wherein a serial circuit of a switching device and a display device is serially connected to output of a transistor on the mirror side of said current mirror circuit.

3. A constant current drive device according to claim 2, wherein said display device is an organic EL device.

4. A constant current drive device according to claim 2, wherein said display device is a light emitting diode device.

5. A constant current drive device according to claim 1, wherein a transistor on the reference side and a transistor on the mirror side of said current mirror circuit and the first and the second switching means are constituted by filed effect transistors respectively.

6. A constant current drive device according to claim 1, wherein said current holding capacitor carries out charging when said current mirror circuit is selected.

7. A constant current drive device according to claim 1, wherein said reference voltage change-over means comprises:

read-out means for reading out the respective reference voltages of said memory means in synchronism with selection periods of the current mirrors; and a digital to analog converter circuit for converting digital reference voltage of said read-out means to analog reference voltage.

* * * * *